US007383615B2

(12) United States Patent
Pozzi

(10) Patent No.: US 7,383,615 B2
(45) Date of Patent: Jun. 10, 2008

(54) HINGE FOR FURNITURE

(75) Inventor: Alberto Pozzi, Orsenigo-Como (IT)

(73) Assignee: System Holz S.p.A., Como (IT)

( * ) Notice: Subject to any disclaimer, the term of this patent is extended or adjusted under 35 U.S.C. 154(b) by 300 days.

(21) Appl. No.: 10/503,748

(22) PCT Filed: Feb. 12, 2003

(86) PCT No.: PCT/EP03/01393

§ 371 (c)(1),
(2), (4) Date: May 19, 2005

(87) PCT Pub. No.: WO03/069102

PCT Pub. Date: Aug. 21, 2003

(65) Prior Publication Data

US 2005/0251963 A1 Nov. 17, 2005

(30) Foreign Application Priority Data

Feb. 15, 2002 (IT) ..... MI2002A0297

(51) Int. Cl.
*E05D 7/12* (2006.01)

(52) U.S. Cl. ..... 16/272; 16/271; 16/258

(58) Field of Classification Search ..... 16/271, 16/257, 258, 261, 382, 236–237, 272
See application file for complete search history.

(56) References Cited

U.S. PATENT DOCUMENTS 3,423,786 A * 1/1969 Arias, Jr. et al. ..... 16/257
4,937,917 A * 7/1990 Rock et al. ..... 16/245
5,577,297 A * 11/1996 Lautenschlager et al. ..... 16/382
5,611,112 A * 3/1997 Rock et al. ..... 16/237
5,632,064 A * 5/1997 Lautenschlager ..... 16/272

(Continued)

FOREIGN PATENT DOCUMENTS

EP 0 547 438 6/1993

(Continued)

*Primary Examiner*—Chuck Y. Mah
(74) *Attorney, Agent, or Firm*—James V. Costigan; Hedman & Costigan, P.C.

(57) ABSTRACT

Hinge for fastening a door (12) to a side wall (11) of a piece of furniture, comprising a first element of the hinge (20) fixed to the side wall (11), a second element of the hinge (40) fixed to the door (12) of the piece of furniture, and an intermediate element (60) hinged to the first element of the hinge (20), for allowing the oscillating connection of the first hinge element (20) to the second hinge element (40) to enable the articulation of the door (12) with respect to the side wall (11) of the piece of furniture, the intermediate element (60) being equipped with an adapter (70) suitable for being inserted in a housing (41), incorporated in the second hinge element (40), by means of a linear sliding "drawer-like" movement, the adapter being blocked by the insertion of a tooth (77) on the adapter (70) into a groove (53) and a matching element (54), situated on a lid (52) attached by means of a hinge (48) along the edge of an anchoring plate (50) incorporated inside the second hinge element (40) allowing it to be reversed from a closed position in contact with the anchoring plate (50), to an open position obtained by a rotation around the hinge (48), varying from a few degrees to 90 degrees.

11 Claims, 7 Drawing Sheets

U.S. PATENT DOCUMENTS

| | | | | | |
|---|---|---|---|---|---|
| 5,715,577 | A | * | 2/1998 | Lautenschlager et al. | 16/383 |
| 5,806,144 | A | * | 9/1998 | Fries | 16/246 |
| 5,979,017 | A | * | 11/1999 | Karl | 16/383 |
| 6,073,311 | A | * | 6/2000 | Lautenschlager | 16/383 |
| 6,694,567 | B1 | * | 2/2004 | Domenig et al. | 16/238 |

FOREIGN PATENT DOCUMENTS

| | | | | |
|---|---|---|---|---|
| JP | 08110152 | A | * | 4/1996 |
| JP | 2001349125 | A | * | 12/2001 |
| JP | 2004324059 | A | * | 11/2004 |
| WO | WO 9010775 | A1 | * | 9/1990 |

* cited by examiner 20
11
21
23
24
61
25
60
40
73
54
48
12

20
22
VI
11
21
24
62
72
61
40
42
42
63
77
52
55
VI
12

HINGE FOR FURNITURE

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1. Field of the Invention

The present invention relates to a hinge for furniture.

2. Description of Related Art

In particular, the invention relates to a hinge for furniture including a first element to be fixed to the inside of a side wall of a piece of furniture, a second element to be fixed to a door and an intermediate element, hinged to the first element to enable the reciprocal articulation of the first and second element, so as to allow the opening and closing of the door.

Hinges of this type have been known for some time, as they simplify the assembling and dismantling operations of furniture doors and the necessary regulations for the correct assembly functioning.

A hinge of the above-mentioned type is described in Italian patent application Nr. BS91A0000089.

According to the disclosure of said patent application, a single pin hinge for furniture for fixing a door to a side wall of a piece of furniture, comprises an element fixed on the door, with a portion inserted therein, and an element fixed on the wall of the furniture, equipped with a hinge, the element fixed on said wall having an orientable portion, articulated on the pin of the hinge and connected to the element fixed on the door, when the hinge has been assembled. The orientable portion has an intermediate element, suitable for being inserted into a housing present in the element fixed to the door; a release device is included for blocking the intermediate element, which holds said element once it is inserted in the housing, by means of a rotation around its hinging point and pressure towards the bottom of the housing.

The hinge according to the above invention has the drawback of completely disinserting the part of the hinge fixed to the wall of the furniture from the element fixed to the door, during the dismantling of the door. This means that the operator must sustain the door in the correct position until all the hinges have been released, to prevent the door from falling and to prevent the whole weight of the door from resting on the last hinge to be released.

A second drawback of the hinges described above and so far known, is the necessity of resorting to tools for the disassembling of the hinge.

The general objective of the present invention is to solve the above drawbacks of the known art in a very simple, economical and particularly functional way.

A further objective of the invention, in addition to providing a system capable of safely supporting the door during the assembly and dismantling operations, is to facilitate said operations, above all when there is only one operator.

Also included in the objectives of the present invention is to provide a hinge which, thanks to the particular draft configuration of its insertion elements, allows easy assembly and guarantees an accurate coupling when said elements are in a closed position.

In view of the above objectives, a hinge for furniture has been conceived, according to the present invention, having the characteristics specified in the enclosed claims.

BRIEF SUMMARY OF THE INVENTION

The invention provides a hinge for fastening a door (12) to a side wall (11) of a piece of furniture, comprising a first hinge element (20) adapted to be fixed to a side wall (11), a second hinge element (40) adapted to be fixed to the door (12) of the piece of furniture, and an intermediate element (60) hinged to said first element of the hinge (20), for allowing the oscillating connection of the first hinge element (20) to the second hinge element (40) to enable the articulation of the door (12) with respect to the side wall (11) of the piece of furniture, characterized in that the intermediate element (60) is equipped with an adapter (70) suitable for being inserted in a housing (41), incorporated in the second hinge element (40), by means of a linear sliding movement, and in that said adapter is blocked by the insertion of a tooth (77) situated on said adapter (70) into a groove (53) and a matching element (54), situated on a lid (52) attached by means of a hinge (48) along the edge of an anchoring plate (50), incorporated inside the second hinge element (40), allowing it to be reversed from a closed position in contact with the anchoring plate (50), to an open position obtained by a rotation around the hinge (48), varying from a few degrees to 90 degrees.

BRIEF DESCRIPTION OF THE SEVERAL VIEWS OF THE DRAWINGS

The structural and functional characteristics of the present invention together with its advantages with respect to the known art will appear clearer and more evident from an examination of the following description, referring to the enclosed drawings, which illustrate a hinge for furniture achieved according to the innovative principles of the invention itself.

In the drawings.

DETAILED DESCRIPTION OF THE INVENTION

Figure 1:
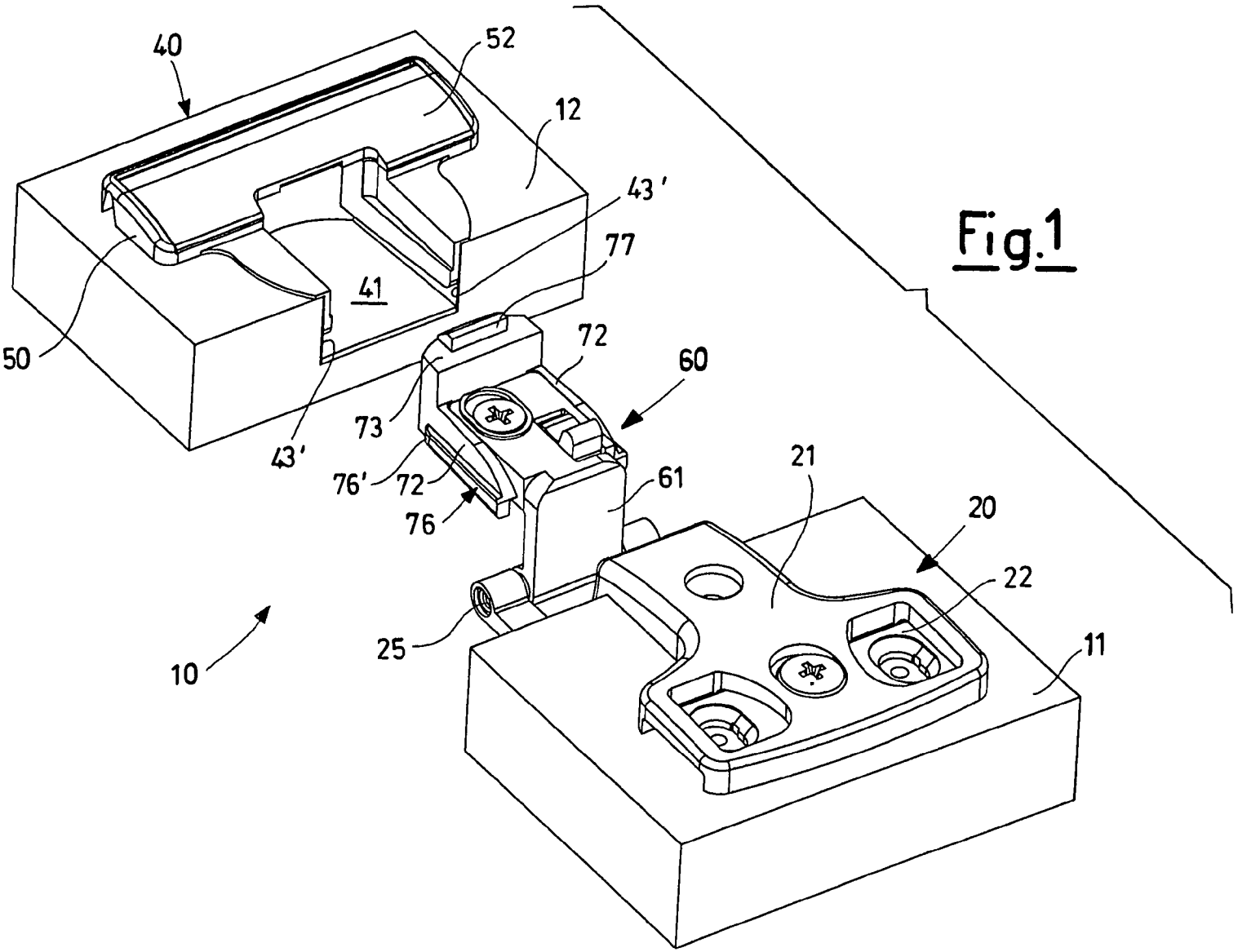
FIG. 1 represents a perspective view of a hinge for furniture, according to the invention, with the door dismantled.
Figure 3:
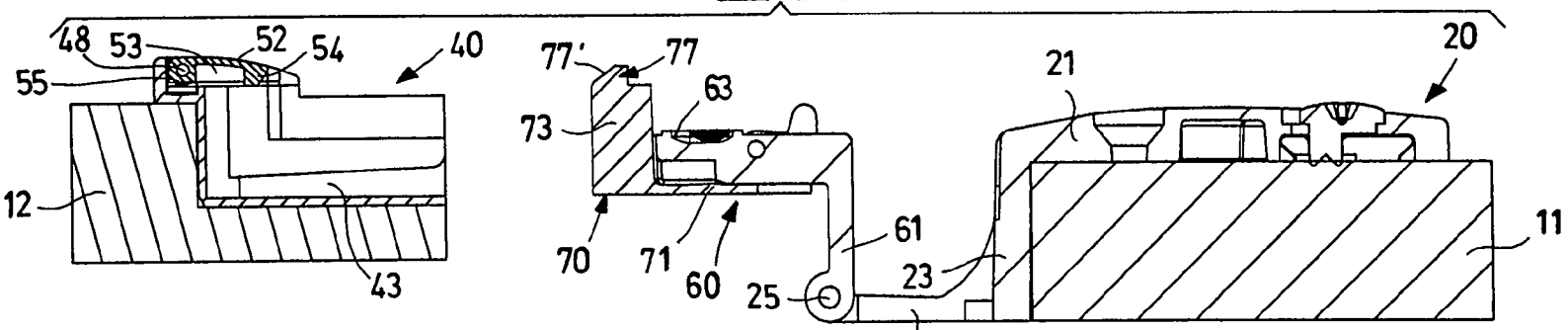
FIG. 3 represents a section along the line III-III of FIG. 2.
Figure 2:
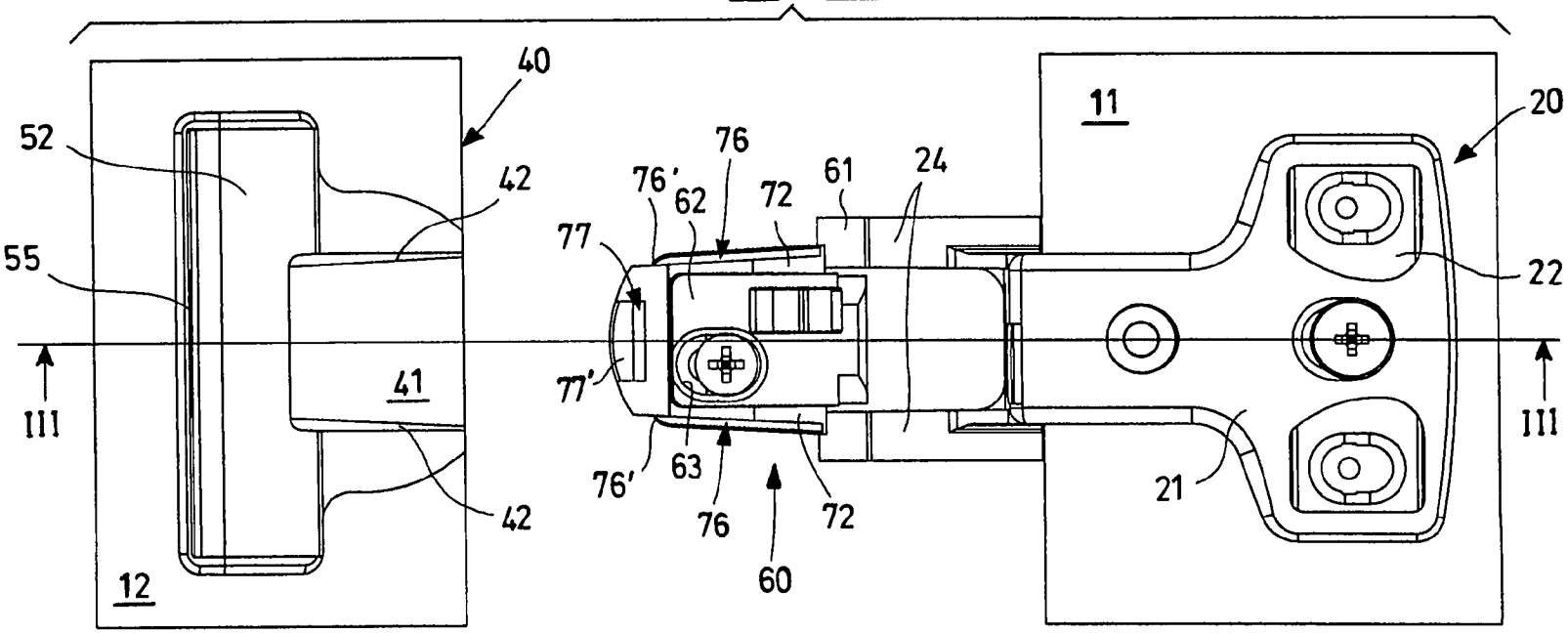
FIG. 2 represents a plan view of the hinge of FIG. 1.
Figure 4:
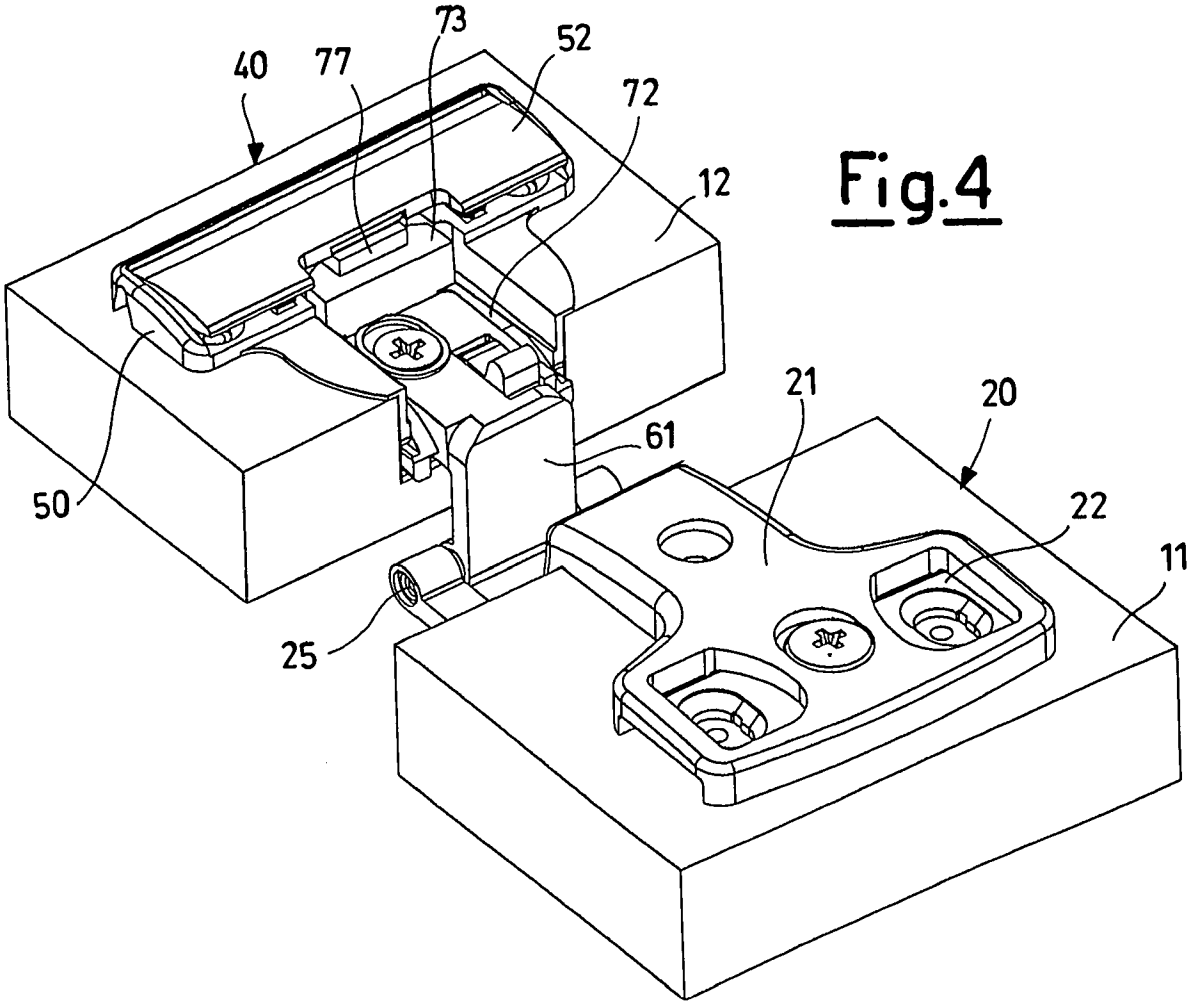
FIG. 4 represents a perspective view of the hinge of FIG. 1, with the door assembled.

With reference to the drawings, a hinge for furniture, object of the invention, conceived for fixing a door to the side wall of a piece of furniture, is indicated, as a whole, with 10 and, in the example illustrated according to the present invention, includes a first hinge element 20, fixed to a wall 11 of a piece of furniture and a second hinge element 40 fixed to a door 12 of the piece of furniture.

The first hinge element 20 is in the form of a shaped plate and has a first flat portion 21 for fixing it to the inside wall of the furniture by means of screws.

In this respect, a centering plate 22 fixed to said first portion 21 is inserted between the first flat portion 21 and the wall of the furniture.

A second portion 23 extends perpendicularly from the first portion 21, said second portion having the same profile as the side wall 11 beyond its edge adhering to the edge itself.

A fork 24 protruding from the edge of the furniture extends perpendicularly from the second portion 23, and is therefore parallel again to the surface of the wall 11 of the furniture.

At the end of the fork 24, an intermediate hinge element 60 is oscillatingly fixed with a hinge 25 to one of its two ends, forming an orientable articulated portion for the oscillating connection of the first hinge element 20 to the second hinge element 40 to allow the articulation of the door 12 with respect to the wall 11 of the piece of furniture.

The intermediate element 60 is substantially L-shaped and has a first portion 61 hinged to the fork 24 and a second portion 62 perpendicular to the first, on which an adapter 70 suitable, for being connected with the second hinge element 40, is inserted.

To allow its insertion on the second portion 62 of the intermediate element 60, the adapter 70 has a base 71, two side walls 72 and a back wall 73 which surround the second portion 62.

A through hole 63 situated on the second portion 62 allows the position of the adapter 70 to be fixed and regulated by the insertion of a screw inside a threaded bushing (not illustrated) situated on the base 71 of the adapter 70.

The insertion of the second portion 62 of the intermediate element 60 containing the adapter 70 inside the second hinge element 40 is achieved with a linear sliding "drawer-like" movement, thanks to longitudinal matching elements 76 externally positioned along the side walls 72 of the adapter 70 and whose sliding is guided within grooved guides 43 situated along the walls 42 and for which there is a housing 41 incorporated in the second hinge element 40.

In order to facilitate the assembly of the second portion 62 of the intermediate element 60 inside the housing 41 and also guarantee a precise coupling once these elements are in a closed position, said second portion 62 and, correspondingly, said housing 41, are tapered, and broaden out starting, respectively, from the inserting end of said second portion 62 and from the bottom of said housing 41, so as to create a draft which facilitates said insertion.

For the same reasons, the longitudinal matching elements 76 are tapered and broaden out vertically starting from the ends 76' to be inserted inside the grooved guides 43 which correspondingly have enlarged mouths 43', are tapered and become narrow towards the end of housing 41.

Said ends 76' also have rounded edges to facilitate insertion inside the grooved guides 43.

The second hinge element 40 also comprises an anchoring plate 50 of the element to the door 12, having a substantially quadrangular shape, connected along one side to said housing 41 and equipped with holes 51 for the screwing of the door 12.

A blocking element is also assembled on the anchoring plate 50, on the opposite side with respect to that connected to the housing 41, consisting of a lid 52 attached by the hinge 48, so that it can be reversed from a closed position in contact with the anchoring plate 50, to an open position obtained by a rotation around the hinge, varying from a few degrees to 90 degrees.

The lid 52 is equipped with a groove 53 for housing a tooth 77 protruding from the upper surface of the back wall 73 of the adapter 70.

The lid 52 also has a matching element 54, situated along the side of the groove 53, for the insertion of the tooth 77, when the lid 52 is closed, in order to block the adapter 70 with a release movement, and consequently connect the two hinge elements 20 and 40.

The matching element 54 also enables the adapter to be inserted inside the housing 41, even when the lid 52 is closed.

For this purpose, the tooth 77 has a sloping surface 77' which allows it to slide, during the drawer-like movement for the insertion of the adapter 70 inside the housing 41, along a corresponding sloping surface 54' positioned on the matching element 54, so as to lift the lid 52, by rotation around the hinge 48, to an angle suitable for allowing the insertion of the tooth 77 inside the groove 53 and for allowing the lid 52 to close with a click, once the tooth 77 has passed over the matching element 54.

A leaf spring 55, arranged in contact with the edge of the lid 52, below the hinge 48, is provided to guarantee the return to the closed position of the lid 52.

Figure 7:
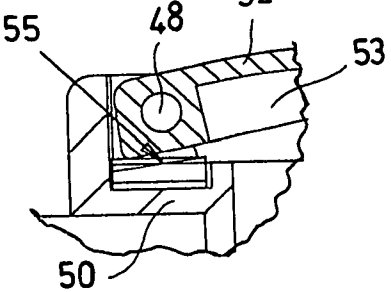
FIG. 7 represents the section of a detail of the hinge of FIG. 6.
Figures 5, 6:
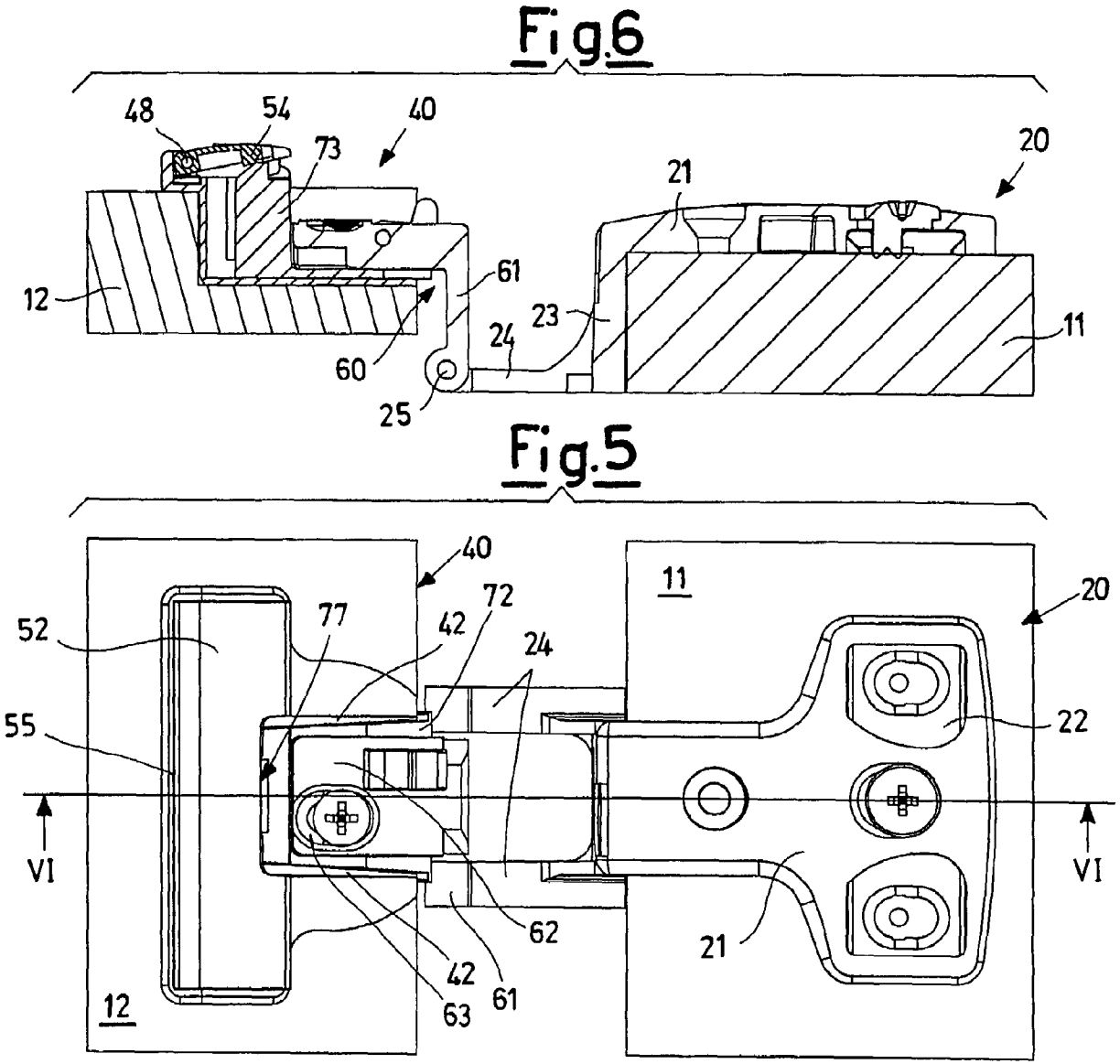
FIG. 5 is a plan view of the hinge of FIG. 4.
FIG. 6 is a section along the line VI-VI of FIG. 5.
Figure 8:
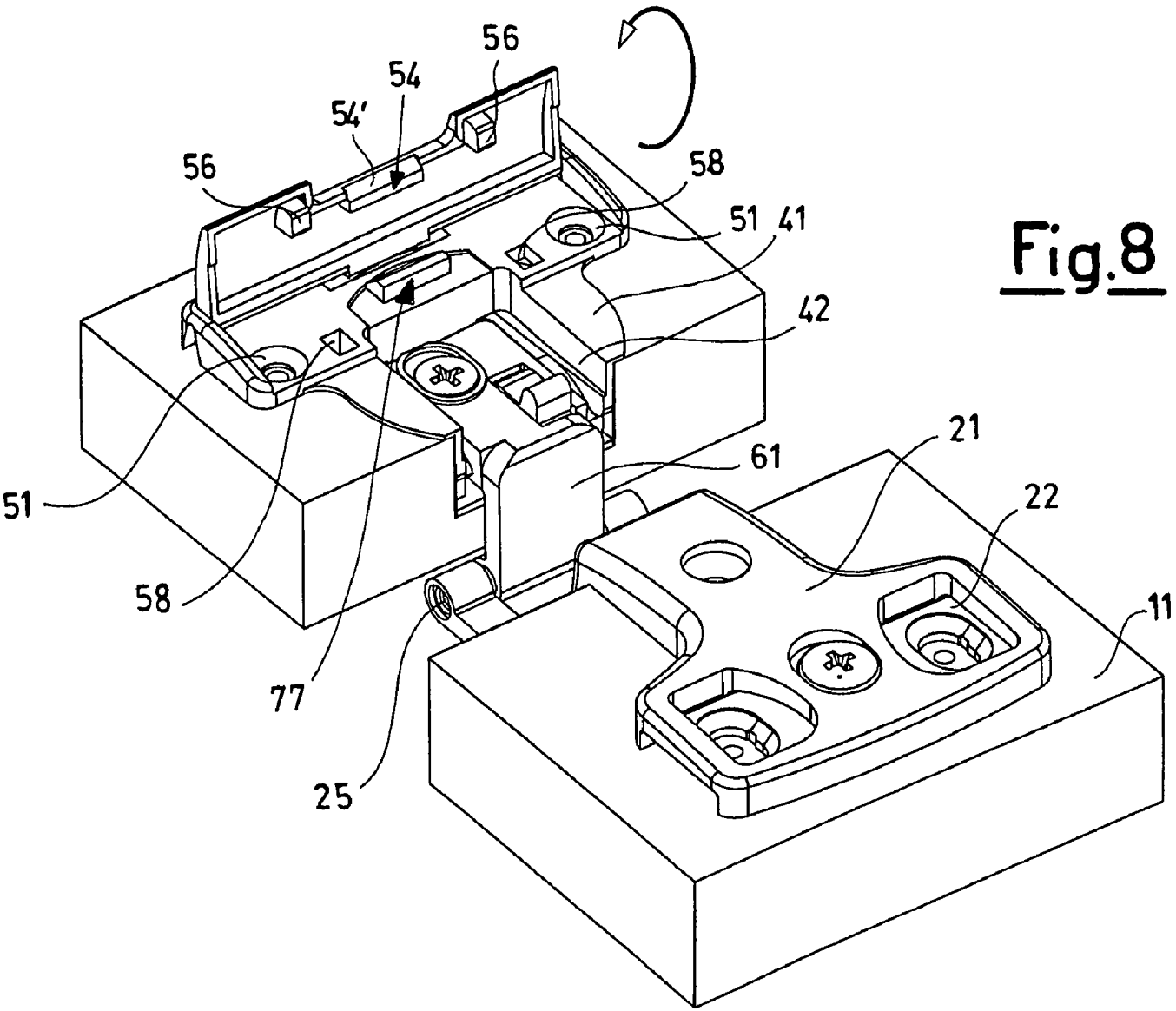
FIG. 8 represents a perspective view of the hinge of FIG. 4 with the door unblocked.

The leaf spring, in combination with the particular section of the part of the lid 52 in contact therewith (FIG. 7), has two functions:

1. to bring the lid back to a closed position.
   In this way, the assembly operation is greatly facilitated and is limited to the insertion and pushing of the door, without any direct manoeuvring on the hinge. A firm fastening is also guaranteed.
2. During the assembly phase, when the lid is rotated beyond a certain angle, the thrust of the spring produces a contrary effect, ensuring the opening of the lid and the release of the hinge.

A pair of teeth 56 protruding below said lid 52, at the sides of the tooth 77, suitable for being inserted inside the corresponding opening 58, situated in the anchoring plate 50, are provided to make the closing of the lid 52 structurally more solid.

It is evident how the assembly and dismantling of the door can be effected without any particular difficulty, safely, and without operating under precarious conditions, as once the intermediate element had been unblocked by lifting the lid 52, it is still supported inside the housing 41.

For particular safety requirements, such as those requested by the regulations of certain countries, the hinge must be provided with additional means against accidental release, as may occur with the intervention of children.

Figure 9:
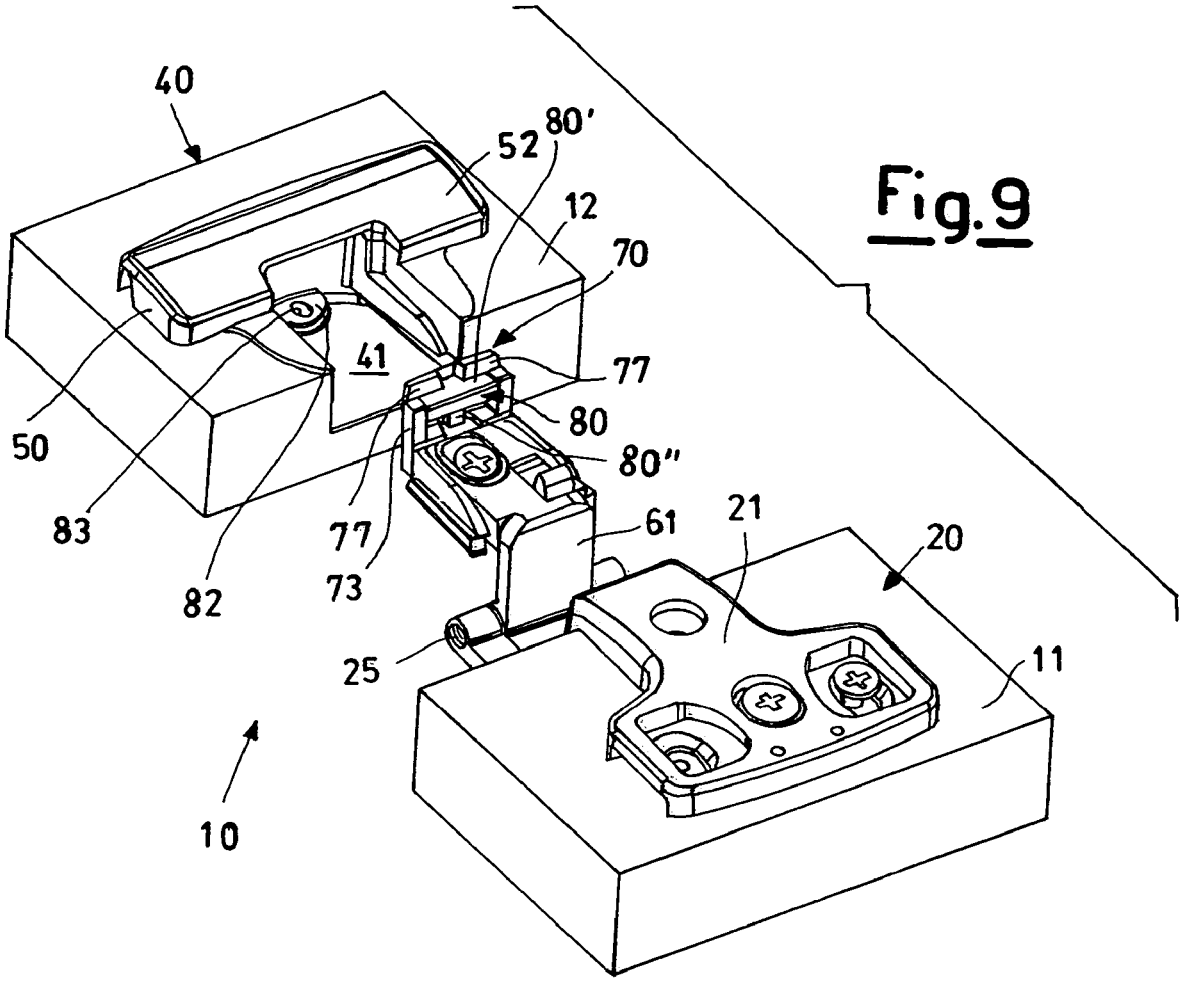
FIG. 9 shows a perspective view of a hinge for furniture according to a variant of the embodiment of the invention with the door dismantled.
Figure 10:
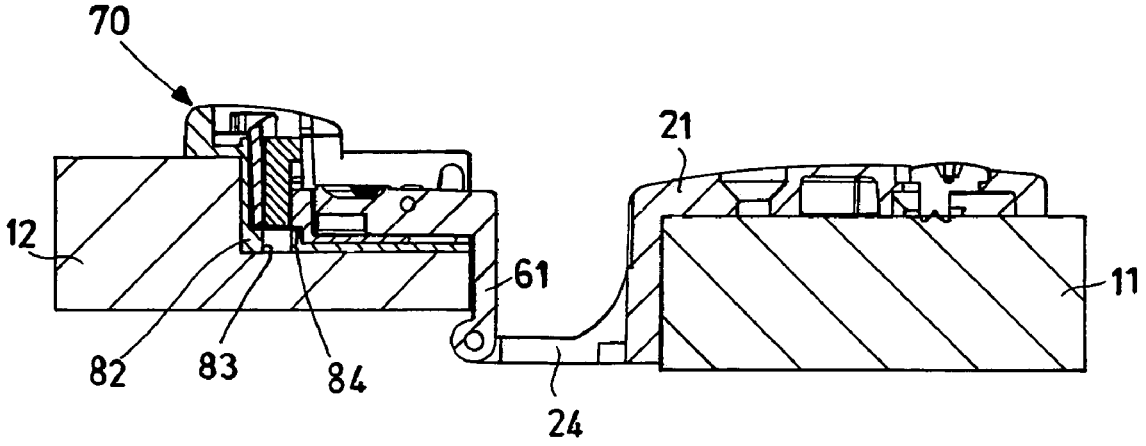
FIGS. 10 and 11 respectively show, in a longitudinal section, two operative positions of the variant of the embodiment of the hinge of FIG. 9 with the door assembled.
Figure 11:
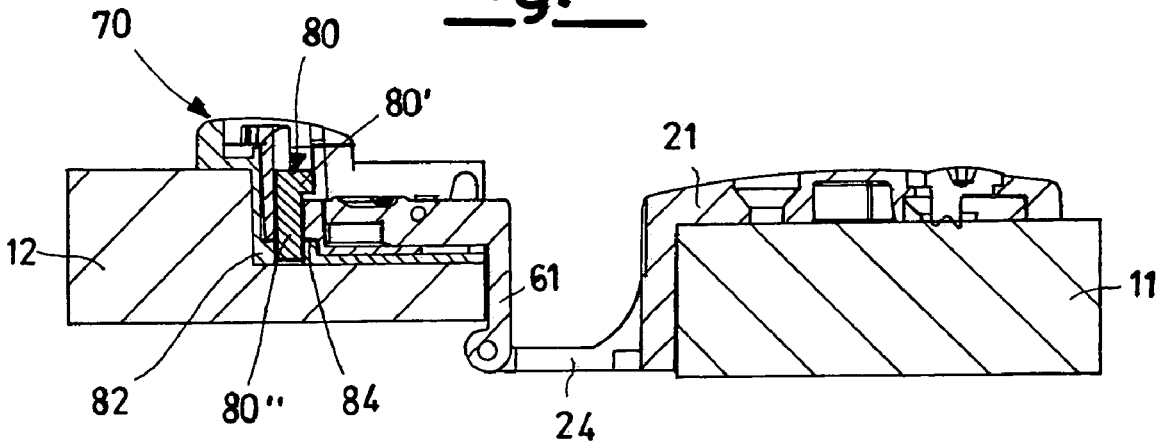

The intermediate element 60, as shown in FIGS. 9 to 11, is equipped with a stop 80, which slides and is inserted into the back wall 73 of the adapter 70 and is elastically held in position.

Said stop 80 is "T"-shaped, being equipped with an upper element 80', substantially enlarged and horizontal, and with a lower vertical shank 80".

On the upper element 80', it is possible both to move the stop 80 to the blocking position and also to release it in the unblocked position.

In the former case, the stop 80 will have the shank 80" inserted in an opening 83 situated in a surfacing 82 situated on the bottom of the housing 41, whereas, in the latter case, said shank 80" will be positioned outside the opening 83.

For safety reasons, a certain pressure must be applied on the upper element 80' of the stop to obtain said unblocking, using a tool such as a screwdriver, in order to prevent unblocking on the part of children.

A blunting 84 is present on the back wall 73 corresponding to the surfacing 82 on the bottom of the housing 41, and having the same shape.

From the above description with reference to the figures, it can be seen how a furniture hinge, according to the invention, is particularly useful and advantageous. The objective mentioned in the introduction of the description is thus achieved.

The hinge according to the invention can obviously have different shapes from those shown in the drawings which are purely illustrative and non-limiting examples.

The scope of the invention is consequently delimited by the enclosed claims.

I claim:

1. A hinge for fastening a door (12) to a side wall (11) of a piece of furniture, comprising a first hinge element (20) adapted to be fixed to a side wall (11), a second hinge element (40) adapted to be fixed to the door (12) of the piece of furniture, an intermediate element (60) hinged to said first element of the hinge (20), for allowing the oscillating connection of the first hinge element (20) to the second hinge element (40) to enable the articulation of the door (12) with respect to the side wall (11) of the piece of furniture, the intermediate element (60) being equipped with an adapter (70) having a tooth (77) situated on said adapter (70), said adapter (70) being suitable for being inserted in a housing (41), which is present in the second hinge element (40), by means of a linear sliding movement, said housing (41) having a groove (53) located therein which engages tooth (77) of adapter (70) to block said intermediate element (60) from being removed from said housing (41) after it is inserted said second hinge element (40) having an element (54) situated on a lid (52) of said second hinge element (40) for engaging said tooth (77), said second hinge element (40) being attached to an anchoring plate (50) by means of a hinge (48) along the edge of said anchoring plate (50), wherein said element (54) may be reversed from a closed position in contact with the anchoring plate (50), to an open position obtained by a rotation around the hinge (48), up to 90 degrees characterized in that said lid (52) has a pair of teeth (56) protruding from said lid (52) at the sides of said element (54), said pair of teeth (56) being suitable for insertion within openings (58) situated in the anchoring plate (50), in order to make the closing of the lid structurally more solid.

2. The hinge according to claim 1, wherein said tooth (77) protrudes from a back wall (73) with which the adapter (70) is equipped, and said tooth (77) has a sloping surface (77') suitable for contact with a corresponding sloping surface (54') positioned on element (54), in order to position the lid (52), during the assembly phase of the door, to an angle suitable for allowing the insertion of said tooth (77) inside the groove (53) and to obtain blockage, by means of the click insertion of the tooth (77) within said matching element (54).

3. The hinge according to claim 2, wherein a leaf spring (55) is situated near the hinge (48) of said lid (52), suitable for coming into contact with an edge of the lid (52) to guarantee the return of the lid (52) from an open to a closed position, said open position being effected by means of rotation to a variable angle.

4. The hinge according to claim 2, wherein said intermediate element (60) is substantially "L"-shaped and has a first portion (61) hinged to a fork (24 at one end of said first hinge element (20) and a second portion (62), perpendicular to said first portion (61), on which said adapter is inserted.

5. Then hinge according to claim 4, wherein said adapter (70) has a base (71), two side walls (72) and a back wall (73) which surround said second portion (62).

6. The hinge according to claim 5, wherein on said second portion (62) there is a through-hole (63) which allows the position of the adapter (70) to be fixed and regulated by means of a screw.

7. The hinge according to claim 6, wherein the adapter (70) has longitudinal matching elements (76) externally protruding along the side walls (72) suitable for sliding with a linear movement, and being guided within grooved guides (43) situated along the walls (42) of the housing (41).

8. The hinge according to claim 7, wherein said second portion (62) and, correspondingly, said housing (41) are tapered, so that they broaden out starting, respectively, from the end to be introduced of said second portion (62) and from the bottom of said housing (41), to facilitate said introduction.

9. The hinge according to claim 8, wherein said longitudinal matching elements (76) are tapered and broaden out vertically starting from the ends (76') to be inserted within the grooved guides (43) which, correspondingly, have enlarged mouths (43') and are tapered so as to become narrow towards the bottom of the housing (41).

10. The hinge according to claim 2, wherein said adapter (70) is equipped with a stop (80) which slides into the back wall (73) and is suitable for being inserted inside an opening (83) situated in the housing (41).

11. The hinge according to claim 10, wherein said stop (80) is "T"-shaped, being equipped with an upper element (80') substantially enlarged and horizontal, and with a lower vertical shank (80") suitable for being inserted inside said opening (83).

* * * * *